US007713112B2

(12) United States Patent
Huang

(10) Patent No.: US 7,713,112 B2
(45) Date of Patent: May 11, 2010

(54) PRECISION CERAMIC WHETSTONE

(76) Inventor: Po-Yuan Huang, P.O. Box 166-13, Taipei (TW) 115

( * ) Notice: Subject to any disclaimer, the term of this patent is extended or adjusted under 35 U.S.C. 154(b) by 0 days.

(21) Appl. No.: 11/979,283

(22) Filed: Nov. 1, 2007

(65) Prior Publication Data

US 2009/0117838 A1 May 7, 2009

(51) Int. Cl.
*B24B 15/06* (2006.01)
*B24B 15/08* (2006.01)

(52) U.S. Cl. ..... 451/525; 451/524; 451/557

(58) Field of Classification Search ..... 451/45, 451/523, 524, 525, 540, 557
See application file for complete search history.

(56) References Cited

U.S. PATENT DOCUMENTS

| | | | | | |
|---|---|---|---|---|---|
| 678,301 | A * | 7/1901 | Lucas | 451/557 |
| 1,158,048 | A * | 10/1915 | Hawks | 76/88 |
| 1,352,888 | A * | 9/1920 | Gallagher | 76/84 |
| 2,380,539 | A * | 7/1945 | Miller | 451/557 |
| 2,896,482 | A * | 7/1959 | Hyde | 76/84 |
| 3,420,123 | A * | 1/1969 | Waterman | 76/84 |
| 4,094,106 | A * | 6/1978 | Harris | 451/555 |
| 4,197,677 | A * | 4/1980 | Graves | 451/555 |
| 5,458,534 | A * | 10/1995 | Campione et al. | 451/555 |
| 6,371,841 | B1 * | 4/2002 | Ray | 451/523 |
| 6,547,656 | B1 * | 4/2003 | LeVine | 451/424 |
| 7,153,201 | B2 * | 12/2006 | Smith | 451/540 |
| D560,461 | S * | 1/2008 | Epstein | D8/91 |

FOREIGN PATENT DOCUMENTS

| | | |
|---|---|---|
| TW | M310766 | 5/2007 |

* cited by examiner

*Primary Examiner*—Timothy V Eley

(57) ABSTRACT

The aim of the present invention is to provide a ceramic whetstone (3) which can accelerate sharpening cutlery smoothly. The ceramic whetstone (3) includes a ceramic stick (30) with high straightness accuracy having a plastic nut (31) at a first end, a plastic handle (32) at a second end. A bump (311) disposed on the inner area of the bottom of the plastic nut (31), a fixed bump (321) disposed inside the hollow plastic handle (32) to seal a second end, a stop plate (322) disposed on a top end of the handle (32) for shielding the area between thumb and index finger of a user, the stick (30) has an axial hole (301) accommodates the plastic nut (31) and the handle (32) fit over to both ends respectively, the bump (311) and the fixed bump (321) fit in the axial hole (301) to resist against the stick (30).

8 Claims, 4 Drawing Sheets

PRECISION CERAMIC WHETSTONE

FIELD OF THE INVENTION

This invention is related to a whetstone made of ceramics; particularly for sharpening cutlery.

BACKGROUND OF THE INVENTION

A conventional ceramic whetstone, as shown in FIG. 1 is usually made of hardened ceramic powder. The ceramic whetstone (1) includes a handle (10) and a ceramic stick (11) fixed to a first end of the handle (10). It is lighter, stronger for sharpening cutlery than conventional metal whetstone. It costs higher, and is damaged easily. Meanwhile, whetstone made of compact ceramic grits may cause creep deformation to relieve stress.

Accordingly persons skilled in the art have provided some improvement, such as TWM310766 entitled "Hollowed out ceramic whetstone" (As shown in FIGS. 2 and 3) to Cheng-Hsien Shen on May 1, 2007, Shen taught the ceramic whetstone (2) comprising: a handle (20) and a ceramic stick (21), characterized in that a pedestal (22) incorporated to a first end of the handle (20), and flexible covers (23) disposed to both first and second ends of the pedestal (22), the stick (21) is hollowed out for fitting over the pedestal, and the flexible covers (23) resist against an inner wall of an axial hole (211) at both first and second ends respectively, the axial hole (211) is formed through the ceramic stick (21), and a cap (25) fit over a first end of the pedestal (22) to resist against the stick (21); thereby, the stick (21) and the pedestal (22) are integrally coupled together.

The ceramic whetstone has some drawbacks as following:

1. Since the handle (20) and the ceramic stick (21) can't be fixed securely, a metal pedestal (22) is inserted into the ceramic stick (21) and secures the ceramic stick (21) by two flexible covers (23). This implement adds extra weight to the ceramic stick (21), and the cost is high due to complex manufacture.
2. The ceramic stick (21) is manufactured by extrusion moulding in which a high quality of craftsmanship is required to reach a high straightness accuracy. Since a high quality of craftsmanship is not easy to apply, the metal pedestal (22) and flexible covers (23) are necessitated to improve the stability of the ceramic stick (21). However, insufficient straightness accuracy causes vibration of the ceramic stick (21) while sharpening the cutlery; this may lower the quality of sharpening and endanger the safety of the user.
3. The cap (25) fit over the first end of the pedestal (22), a nut (24) and a spacer (26) are added for screwing the cap (25) to the pedestal (22); once the cap (25) is loosely out of contact between the pedestal and the stick (21). It may cause the pedestal separated from the stick to induce damage or breaking down to the stick.
4. A handle (20) is shaped with an overall cylindrical surface, when put it on a table with inclined work surface, it is easy to rolling down to cause accidental damages.
5. A pedestal (22) is made of metal, rusted easily, if electric plated and coating required, may increase manufacturing cost.

SUMMARY OF THE INVENTION

This invention provides a precision ceramic whetstone to accelerate cutlery sharpening procedure smoothly.

The invention is to provide a precision ceramic whetstone (3) comprising a high straightness ceramic stick (30) having a plastic nut (31) at a first end, and a plastic handle (32) at a second end characterized in: a bump (311) disposed on the inner area of the bottom of the plastic nut (31), a fixed bump (321) disposed on a bottom inside the handle (32); a stop plate (322) disposed to a first end of the handle (32) for shielding the area between thumb and index finger of a user, the stick (30) has an axial hole (301) accommodating the plastic nut (31) and the handle (32) fit over both first and second ends respectively with the bump (311) and fixed bump (321) snugly abut against an inner wall of axial hole (301) formed through the stick (30).

A precision ceramic whetstone as claimed wherein an inner wall of the plastic nut (31) and the handle (32), and an outer wall of the stick (30) are spread with glue, the handle (32) and the nut (31) are heat fused to the stick.

A precision ceramic whetstone as claimed wherein the ceramic stick is made of alumina ($Al_2O_3$), a thickness in the range of 3 mm~6 mm, a hardness in the range of Rockwell Hardness C (HRC) HRC70~HRC90, a length in the range of 160 mm~330 mm, a diameter in the range of 15 mm~40 mm, the stop plate (322) is shaped in an octagonal shape, whose diameter is bigger than the handle.

ADVANTAGE OF EMBODIMENTS OF THE INVENTION

Advantages can be achieved by embodiments of the invention as following:

1. The hollowed out ceramic whetstone (30) with an axial hole (301) is shaped by extrusion in one step, it reduces the weight of whetstone, also a rectilinear shape can be retained; thus to avoid shaking when sharpening cutlery. The whetstone increases efficiency for sharpening cutlery (5), prolongs life cycle, and improves safety of implementation of the whetstone.
2. Plastic nut (31) and handle (32) added to the stick (30) can avoid damages happened to both ends of the stick, when whetstone (3) incidentally dropped into a flat surface. The octagonal stop plate (322) at the first end of the handle (32) shields thumb and index finger portion of a user, further prevents the whetstone from rolling over the table surface. Even the whetstone (3) fallen to the ground, the bulged out stop plate (322) is first in contact with the ground; the stick (30) is therefore free of damaging.
3. After heated, the glue is creating a heat fused seal between the handle (32) and the ceramic stick (30), no more repetition steps is necessarily processed to couple the handle to the stick. After adhering, no clearances or fissures may be formed between the handle and the stick. Liquid immersion or specs deposited to the clearance or fissures between them will not happen to the invention.
4. Fixed bump (321) of the handle (32) snugly abuts against the axial hole (301) of the ceramic stick (30) to secure the stick (30) stably; furthermore, the stick (30) as a hand-held implement can be operated easily by users, when sharpening cutlery, it will not cause any shaking.

DETAILED DESCRIPTION OF THE INVENTION

The present invention is described in detail according to the appended drawing hereinafter.

Figure 1:
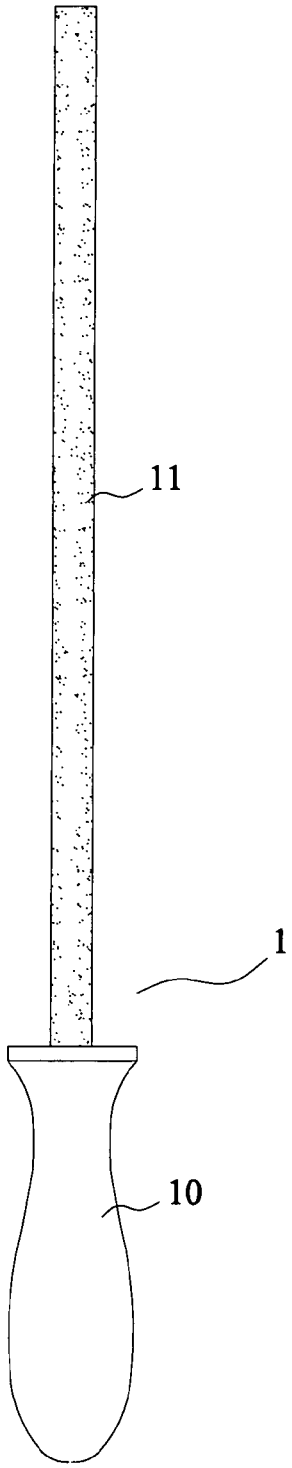
Prior art FIG.1
FIG. 1: shows a schematic view of conventional whetstone made of compact ceramic grits.
Figure 2:
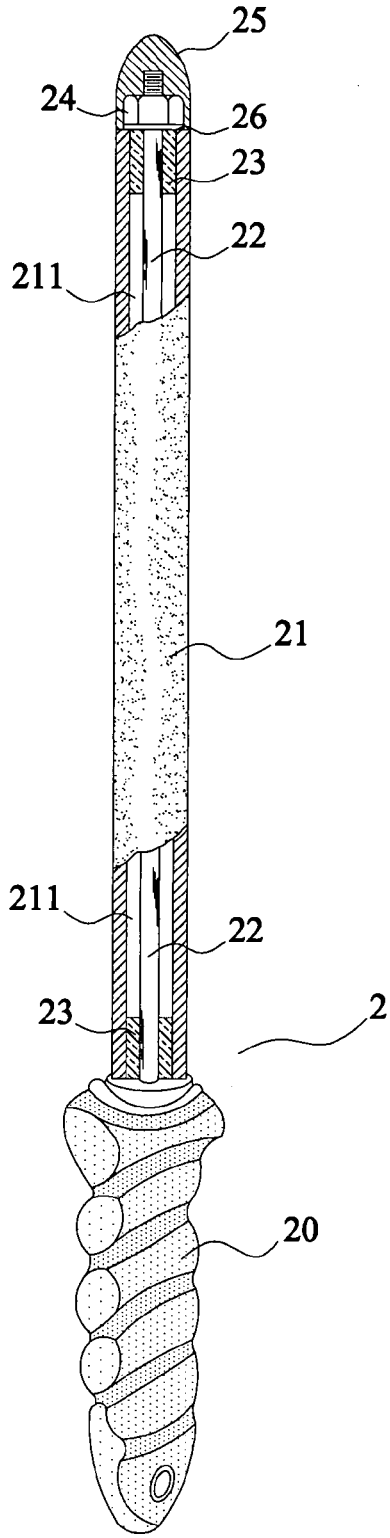
Prior art FIG.2
FIG. 2: shows a schematic view of conventional whetstone made of compact ceramic grits in practice.
Figure 3:
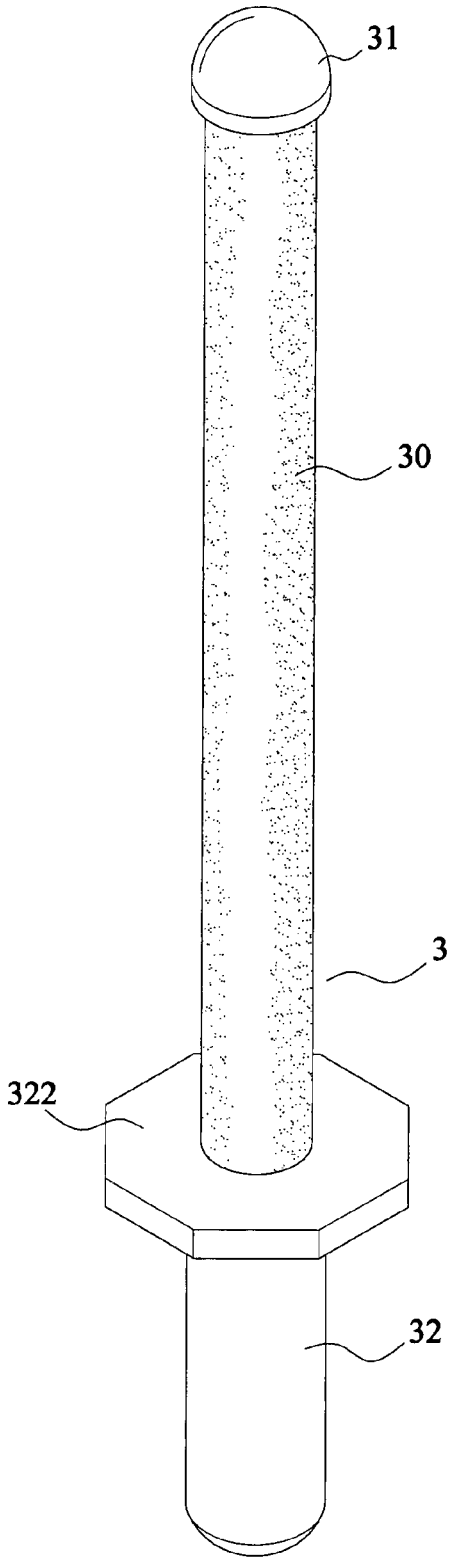
FIG. 3: shows a perspective view of the whetstone made of hollowed out ceramic material of the invention.
Figure 4:
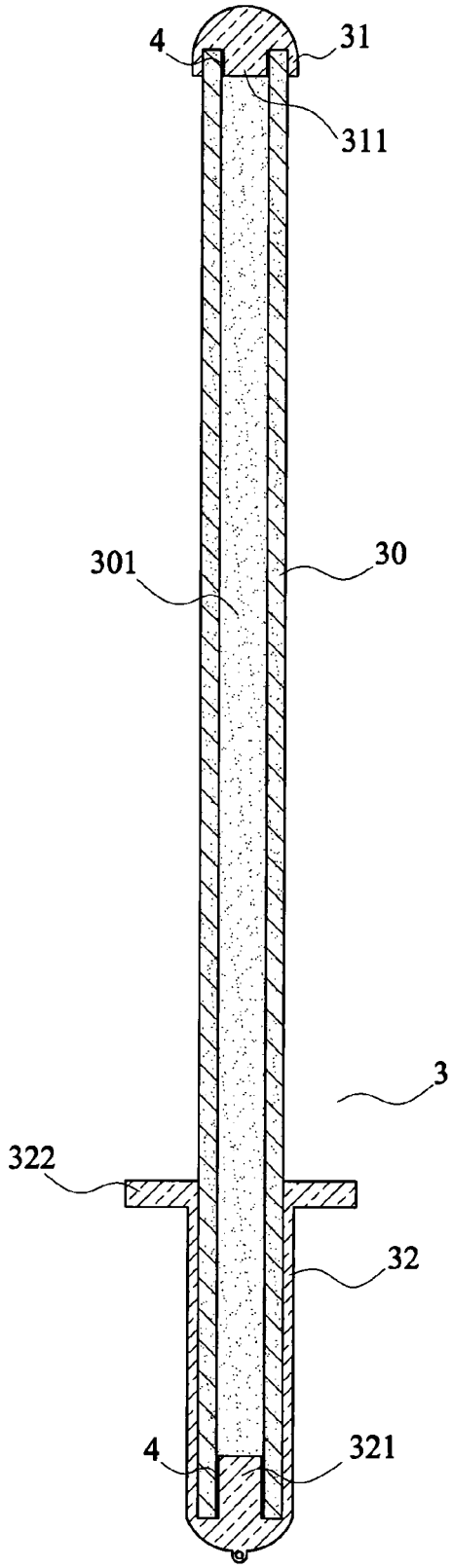
FIG. 4: shows a cross sectional view of FIG. 3.
Figure 5:
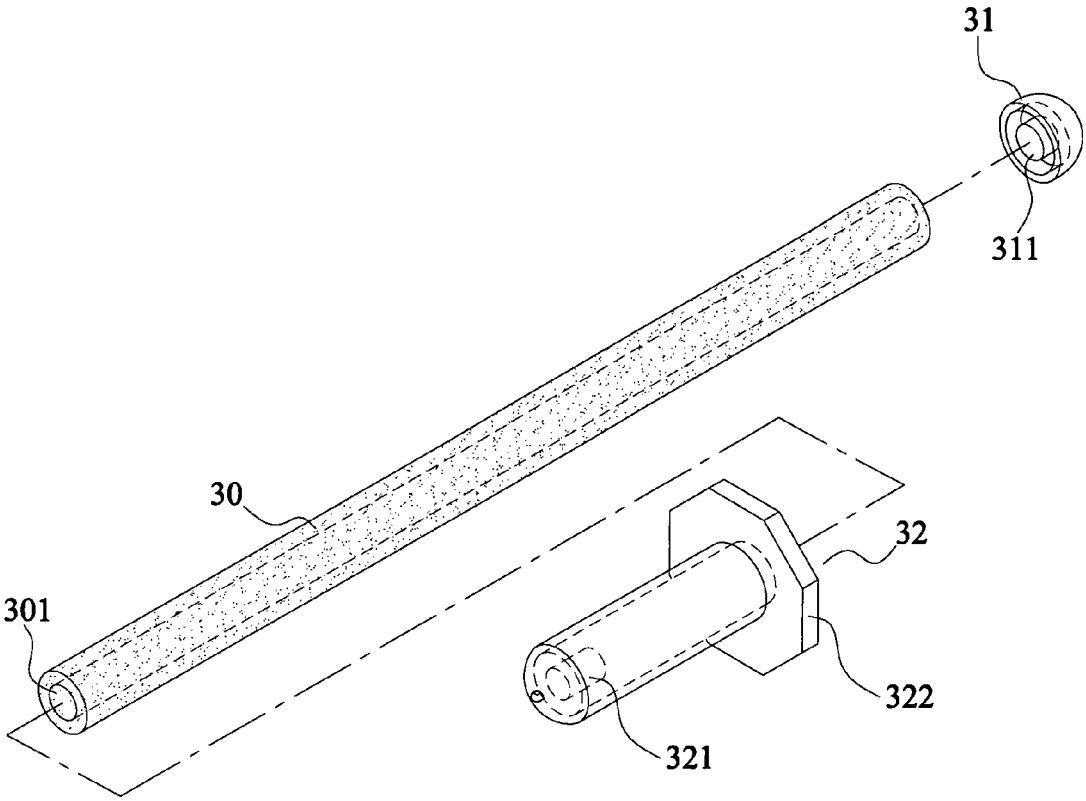
FIG. 5: shows an exploded view of the invention.

As shown in FIGS. 3~5, the precision ceramic whetstone (3) includes a ceramic stick (30) with high straightness accuracy having a plastic nut (31) at a first end, and a plastic handle (32) on a second end. The ceramic whetstone (3) is characteristic of: a bump (311) centrally projected out from a center inside the nut (31) to seal the first end of the stick; a fixed bump (321) centrally projected out from a center inside the handle (32) to seal the second end of the stick, a stop plate (322) fits around a first end of the handle (32) for shielding thumb and index finger portion of a user's hand grip the handle, an axial hole (301) is formed through the stick (30) accommodates the nut (31) and the handle (32) fit in both the first and second ends by the bump and the fixed bump respectively, the bump (311) and the fixed bump (321) fit in the axial hole (301) snugly abut against the stick (30)

The ceramic stick (30) has an axial hole (301) formed through both ends by extrusion in one step to evenly and economically reduce a weight carry by the stick; outer cylindrical surface of the stick or inner cylindrical surface of the axial hole predict an overall length with rectilinear shape. Not only separate piece of ceramic material can be feasibly omitted, but also a weight of the finished stick can be evenly reduced. In addition, it facilitates user's holding and implementing the finished stick in a stable posture. Both nut (31) and handle (32) fit over the first, second ends of the hollowed out stick (30) respectively for ceramic stick (30) crash protection. Moreover, both bump (311) and fixed bump (321) fit in the axial hole to resist against the inner cylindrical surface of the axial hole (301) to increase a stable effect of coupling the stick with the handle and the nut.

Hot melt glue (4) spread over the outer cylindrical surface of the stick (30) and inner cylindrical surfaces of the nut and the handle, after heated, the glue is to adhere the handle (32) and the nut (31) to the ceramic stick (30) at both ends, no more repetition steps is necessarily processed to couple the handle and the nut to the stick. After adhering, no clearances or fissures may be formed between the handle and the stick or the nut and the stick. Liquid immersion or specs deposited to the clearance or fissures to cause rust further can be prevented from happening to the finished stick.

A roundness of the ceramic stick (30) is defined for shaping a typical precision outer diameter with an admissible error in the range of plus or minus ten micrometers (±10 μm). No matter how large or small size of the ceramic stick (30) is demanded, the ceramic stick (30) is formed with a rectilinear shape through overall lengths, whose circular cylindrical surface can be measured to a center at an equal distance thus to define a radius, and can be inferred by a perimeter divided by 2 p, or p to define the typical precision outer diameter, whose roundness is defined with an admissible error, by which a precision overall length rectilinear shape is demanded for, at least, extension of one million meter (1 M) with a longitudinal variance in the range of plus or minus a half millimeter (±0.5 mm) so as to conform to the roundness with admissible error of ±10 μm. Thereby, the rectilinear shape of the stick (30) is better than conventional whetstone made of ceramic grits by injection molding. Even the stick (30) produced through sintering process, it will not result in any deformation occurred to the outer cylindrical surface of the stick. Thereby, parallel degree and roundness of the finished stick (30), though each may be provided with error separated method of measuring datum, but a difference between them as a derived error will not affect an integral performance, it induces cutlery sharpening smoothly and efficiently in consideration of user's safety.

Furthermore, a semi-finished ceramic stick (30) produced by extrusion, passing through drying and sintering process of 1500° C. high temperature, the ceramic stick (30) is endowed with hardness and long wearing durability.

In addition, the high straightness stick (30) can be enhanced by high ceramic particulates density sintered on the outer cylindrical surface of the stick. Thus blade edges (51) of the cutlery (5) can be sharpened finely.

Flexible nut (31) and stop plate (322) are designed to prevent the whetstone (3) from rolling down or dropping off. In addition, the whetstone (3) can be kept an integral wholeness of unified parts without any fissures or clearance occurred to the outer cylindrical surface of the stick (30) etc. Once a fissure or clearance formed on the outer cylindrical surface of the stick (30), it may further lead to the finished stick being broken down, when the whetstone (3) incidentally falling off to the ground or the like.

Moreover, ceramic is characteristic of low thermal conductivity, can retain heat of sharpening, for example, iron aluminide based cutlery, iron dust attached to the outer cylindrical surface of the stick (30) further avoid bacterial cross infection contaminating the food. And the whetstone is easy to hygienically clean germs and make the smell dies away.

When glue (4) heated, the handle (32) and the stick (30) unify into an integral wholeness, thereby it can avoid from being further processed for different machining process, which induces defects to the outer cylindrical surface of the stick, or leaves creeping stress to the stick, which is easy to be damaged or broken down when falling off.

Accordingly, the flexible plate (322) is shaped in an octagonal shape larger then the handle (32) to shield the stick (30) from being broken down when falling off.

The ceramic stick (30) is made of alumina ($Al_2O_3$) suitable for extrusion. The alumina for shaping whetstone is not only cost effective, but available for high-precision process with sufficient hardness and long wearing durability.

A thickness of the ceramic stick (30) is in the range of 3 mm~6 mm, it can be adjusted as desired to adapt to different requirements such as the ceramic stick (30) is required for an extra lengthened size than ever, and an overall length with a precision rectilinear shape, the thickness is necessary to be adjusted to enhance strength to avoid from damaging to the stick.

A hardness of the stick (30) is in the range of Hardness Rockwell C (HRC) HRC70~HRC90, harder than steel cutlery, suitable for sharpening cutlery.

A length of the stick (30) is in the range of 160 mm~330 mm to meet requirements of sharpening most of different sizes of cutlery.

A diameter of the stick (30) is in the range of 15 mm~40 mm to adapt for different length, thickness of the stick (30) for enhancing an integral wholeness of the whetstone (3) for longer term usage without being broken down.

Figure 6A:
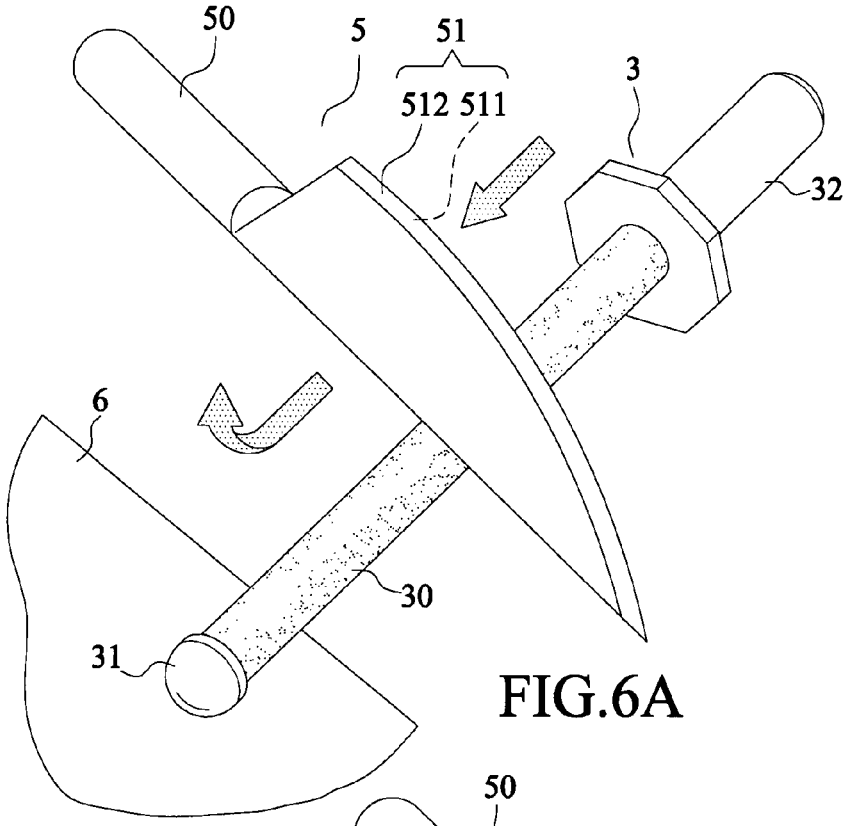
FIGS. 6A, 6B: show schematic views of the invention in use.
Figure 6B:
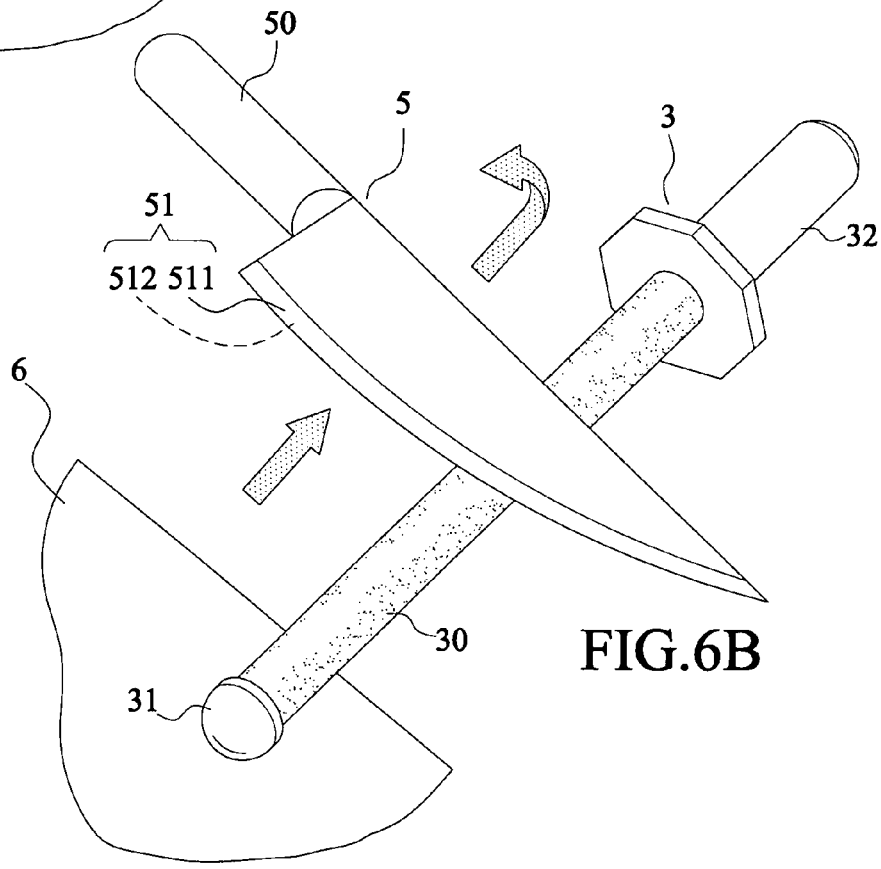

As shown in FIGS. 6A and 6B, schematic views of the finished whetstone (3) in use are illustrated. Since high density micro/nano scale ceramic grits is filled the outer cylindrical surface of the stick to sharpen cutlery, an integral effectiveness is increased to the whetstone (3), which can avoid bacterial cross pollution from occurring to food. And the whetstone is easier to hygienically clean germs and let smells dies away more so than the conventional whetstone. Moreover, the handle (32) and the ceramic stick (30) are integrally combined as a whole one, which is easy to sharpen the cutlery without any shaking.

When sharpening cutlery (5), the nut (31) is first laid on the table surface (6); a single hand-held whetstone (3) is transversally superposed on the table surface (6) at an inclined angle, a blade edge (511) to be sharpened is slid on the whetstone (3). The blade edge (511) can be sharpened by the whetstone in reciprocal movements as the blade edge (511) is moved to and fro against the whetstone. (as shown in FIG. 6A) After that, a blade edge (512) (as shown in FIG. 6B) opposite to the blade edge (511) is used to slide over the whetstone. And the blade edge (512) is moved reciprocally to and fro to the whetstone, thereby, both blade edges (511, 512) can be sharpened safely and effectively.

What is claim claimed:

1. A precision ceramic whetstone (3) comprising a ceramic stick (30) with high straightness accuracy having a plastic nut (31) at a first end, and a plastic handle (32) at a second end characterized in: a first bump (311) is centrally projected out from a center area of the bottom of the plastic nut (31), a fixed bump (321) is centrally projected out from a center area of the bottom of the handle (32); a stop plate (322) is disposed on a first end of the handle (32) for shielding the area between thumb and index finger of a user, an axial hole (301) formed through the stick (30) having first and second ends sealed by the bump (311) of the plastic nut (31) and the fixed bump (321) of the handle (32).

2. The precision ceramic whetstone of claim 1 wherein glue is applied to inner walls of both the plastic nut (31) and the handle (32), and exterior walls of both ends of the stick to adhere the stick to the nut (31) and the handle (32).

3. The precision ceramic whetstone of claim 1 wherein the stick (30) is made of alumina ($Al_2O_3$).

4. The precision ceramic whetstone of claim 1 wherein a thickness of the stick (30) is in the range of 3 mm~6 mm.

5. The precision ceramic whetstone of claim 1 wherein a hardness of the stick (30) is in the range of Hardness Rockwell C (HRC) HRC 70-HRC 90.

6. The precision ceramic whetstone of claim 1 wherein a length of the stick (30) is in the range of 160 mm~330 mm.

7. The precision ceramic whetstone of claim 1 wherein a diameter of the stick (30) is in the range of 15 mm~40 mm.

8. The precision ceramic whetstone of claim 1 wherein the stop plate (322) is shaped in an octagonal shape with a diameter larger than the handle.

* * * * *